US007066128B2

(12) United States Patent
Satake et al.

(10) Patent No.: US 7,066,128 B2
(45) Date of Patent: Jun. 27, 2006

(54) ENGINE CONTROLLER FOR STARTING AND STOPPING ENGINE

(75) Inventors: Nobuyuki Satake, Kariya (JP); Seiichirou Nishikawa, Okazaki (JP); Yoshifumi Murakami, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/181,819

(22) Filed: Jul. 15, 2005

(65) Prior Publication Data

US 2006/0016413 A1 Jan. 26, 2006

(30) Foreign Application Priority Data

Jul. 20, 2004 (JP) ..... 2004-211043

(51) Int. Cl.
*F02N 17/00* (2006.01)

(52) U.S. Cl. ..... 123/179.4; 701/113

(58) Field of Classification Search .. 123/179.3–179.5, 123/179.16, 179.28, 198 DB, 198 DC; 701/105, 701/112, 113
See application file for complete search history.

(56) References Cited

U.S. PATENT DOCUMENTS 4,364,343 A * 12/1982 Malik ..... 123/179.4
5,687,682 A * 11/1997 Rembold et al. ..... 123/179.3
6,050,232 A * 4/2000 Grob et al. ..... 123/179.16
6,062,186 A * 5/2000 Barnes et al. ..... 123/179.3
6,098,585 A * 8/2000 Brehob et al. ..... 123/179.5
6,218,799 B1 * 4/2001 Hori ..... 318/446
6,453,864 B1 * 9/2002 Downs et al. ..... 123/179.3
6,499,342 B1 * 12/2002 Gonzales, Jr. ..... 73/117.3
6,647,955 B1 * 11/2003 Sieber ..... 123/322
6,681,173 B1 * 1/2004 Turner et al. ..... 701/113
6,807,934 B1 * 10/2004 Kataoka et al. ..... 123/179.4
D501,664 S 2/2005 Minamio et al.
6,981,481 B1 * 1/2006 Kojima et al. ..... 123/179.3
2004/0149251 A1 * 8/2004 Nishikawa et al. ... 123/198 DB

FOREIGN PATENT DOCUMENTS

JP 62-255558 11/1987
JP 2002-39038 2/2002

* cited by examiner

*Primary Examiner*—Willis R. Wells
*Assistant Examiner*—Arnold Castro
(74) *Attorney, Agent, or Firm*—Nixon & Vanderhye P.C.

(57) ABSTRACT

During a shut-down period of an engine based on an idle stop control, a computer estimates a power stroke cylinder and a compression stroke cylinder when the engine is stopped. A fuel is injected into the power stroke cylinder and the compression stroke cylinder in an intake stroke just before the engine is stopped. An air-fuel mixture is hold in each cylinder with the engine stopped. When an auto start is required while the engine is stopped, a spark ignition is performed in the power stroke cylinder to start cranking of the engine by combustion energy. At nest ignition timing, a spark ignition is performed in the compression stroke cylinder to start the engine without an aid of a starter.

6 Claims, 9 Drawing Sheets

ENGINE CONTROLLER FOR STARTING AND STOPPING ENGINE

CROSS REFERENCE TO RELATED APPLICATIONS

This application is based on and incorporates herein by reference Japanese Patent Application No. 2004-211043 filed on Jul. 20, 2004, the disclosure of which is incorporated herein by reference.

FIELD OF THE INVENTION

The present invention relates to an engine controller that starts and stops the engine, the engine controller having a function in which the engine can be started without an aid of a starter. The engine is of an intake port injection type.

BACKGROUND OF THE INVENTION

JP-2002-39038A shows a direct injection engine that is started without an aid of a starter, which is referred to as a starter-motorless-start. In the starter-motorless-start, a fuel is injected and ignited in a cylinder that is stopped in the power stroke to generate a combustion energy so that a cranking of engine is caused.

In the intake port injection engine, since an intake valve of the cylinder in the power stroke is closed, the fuel cannot be injected into the cylinder. Thus, the starter-motorless-start, which is disclosed in JP-2002-39038A, cannot be applied to the intake port injection engine.

In an engine control system disclosed in JP-62-255558A, the engine is forcibly stopped at a predetermined poison so that a specified cylinder is always stopped in the power stroke in order to conduct the starter-motorless-start in the intake port injection engine. Just before the engine is completely stopped, the fuel is injected in to the specified cylinder, and then the engine is stopped in a state that the air-fuel mixture is kept in the specified cylinder. In next starting time of engine, the air-fuel mixture is ignited to start the engine. This engine has a shutter valve at the intake port of the specified cylinder in order to forcibly stop the engine at the predetermined position. The shutter valve is closed to prevent an introduction of intake air into the specified cylinder, so that the predetermined specified cylinder is always stopped in the power stroke.

Although the intake port injection engine shown in JP-62-255558A can be started without starter, the structure becomes complicated to cause high-cost. Since the engine is always stopped at the same position, the interval of the engine stop position corresponds to an interval of two rotation of the crankshaft (720° C.A). Unless the engine is forcibly stopped beforehand in a condition where a kinetic energy of inertia rotation is still remained, the inertia rotation of the engine may stop the engine before reaching a next stop position. Thus, it is necessary to stop the engine rapidly, which may cause shocks such as uncomfortable vibrations of the engine.

SUMMARY OF THE INVENTION

The present invention is made in view of the foregoing matter and it is an object of the present invention to provide an engine controller that can start the intake port injection engine without the starter in a low cost and can stop the engine without any shocks due to the rapid stop of the engine.

According to the engine controller of the present invention, a stroke estimating means estimates, during a shutdown period, a stroke of each cylinder when the engine is stopped. The stroke estimating means stores an estimated result. A fuel injection control means injects a fuel, which is required to start the engine in a next starting time, into the cylinder which is estimated to be stopped in a power stroke or in a compression stroke based on the estimated result. A starter-motorless-start control means ignites and combusts an air-fuel mixture in the cylinder that is estimated to be stopped in the power stroke so as to begin a cranking by a combusting energy of the air-fuel mixture. The starter-motorless-start control means ignites at a next ignition timing an air-fuel mixture in the cylinder that is estimated to be stopped in compression stroke in order to start the engine.

BRIEF DESCRIPTION OF THE DRAWINGS

The above and other objects, features, and advantages of the present invention will become more apparent from the following detailed description made with reference to the accompanying drawings, in which like parts are designated by like reference number and in which.

DETAILED DESCRIPTION OF THE PREFERRED EMBODIMENTS

An embodiment of the present invention will be described hereinafter with reference to the drawings.

Figure 1:
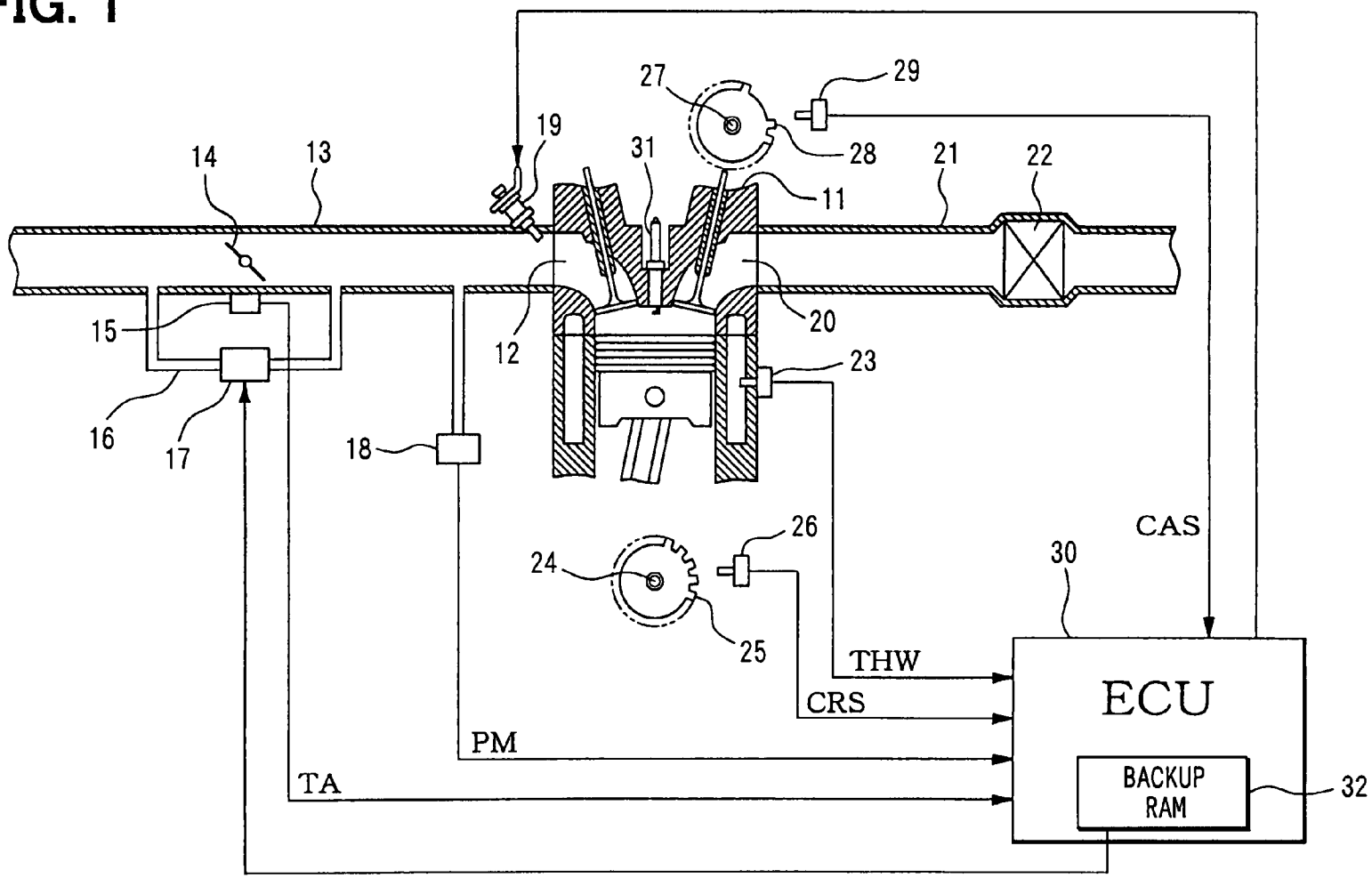
FIG. 1 is a schematic view showing an engine control system.

FIG. 1 is a schematic view of the engine control system. An intake pipe 13 is connected to an intake port 12. A throttle valve 14 is provided in the intake pipe 13. A throttle position sensor 15 detects a throttle position TA of the throttle valve 14. The intake pipe 13 is provided with a bypass passage 16, which bypasses the throttle valve 14. An idle speed valve 17, which is referred to as ISC valve hereinafter, is provided on the bypass passage 16. An intake air pressure sensor 18 that detects the intake air pressure PM is provided downstream of the throttle valve 14. A fuel injection valve 19 is mounted at a vicinity of each intake port 12.

An exhaust pipe 21 is connected to an exhaust port 20 of the engine 11. A catalyst 22 is provided in the exhaust pipe 21 for purifying an exhaust gas. A coolant temperature sensor 23 detecting a coolant temperature THW is provided on a cylinder block of the engine 11. A crank angle sensor 26 is disposed in such manner as to confront to a signal rotor 25, which is connected to a crankshaft 26 of the engine 11. The crank angle sensor 26 outputs a pulse signal in synchronization with a rotation of the signal rotor 25 at every predetermined crank angle (for example, every 10° C.A). The signal rotor 25 has a successive teeth lacked portion corresponding to one pulse signal or more and a single tooth lacked portion. A reference crank angle position is detected based on the successive teeth lacked portion and a single tooth lacked portion. A signal rotor 28 is concentrically provided on the camshaft 27. A cam angle sensor 29 is disposed in such a manner as to confront the signal rotor 28. The cam angle sensor 29 outputs pulse signals in synchronization with the rotation of the signal rotor 28.

The output signals are inputted into an electric control unit 30, which is referred to as an ECU 30 hereinafter. The ECU 30 mainly comprises a microcomputer and controls fuel injection amount and fuel injection period of the fuel injection valve 19, an ignition timing of a spark plug 31, an opening degree of ISC valve 17 and the like. When an auto stop condition is established to turn on an idle stop signal with the engine at idle, the ECU 30 stops the fuel injection and the ignition to stop the engine. When an auto start condition is established during an idle stop, the ECU 30 starts the starter-motorless-start control in which the ECU 30 ignites and combusts an air-fuel mixture in the cylinder that is estimated to be stopped in the power stroke so as to begin a cranking by a combusting energy of the air-fuel mixture, and then the ECU 30 ignites at next ignition timing an air-fuel mixture in the cylinder that is estimated to be stopped in compression stroke in order to restart the engine.

Figure 7:
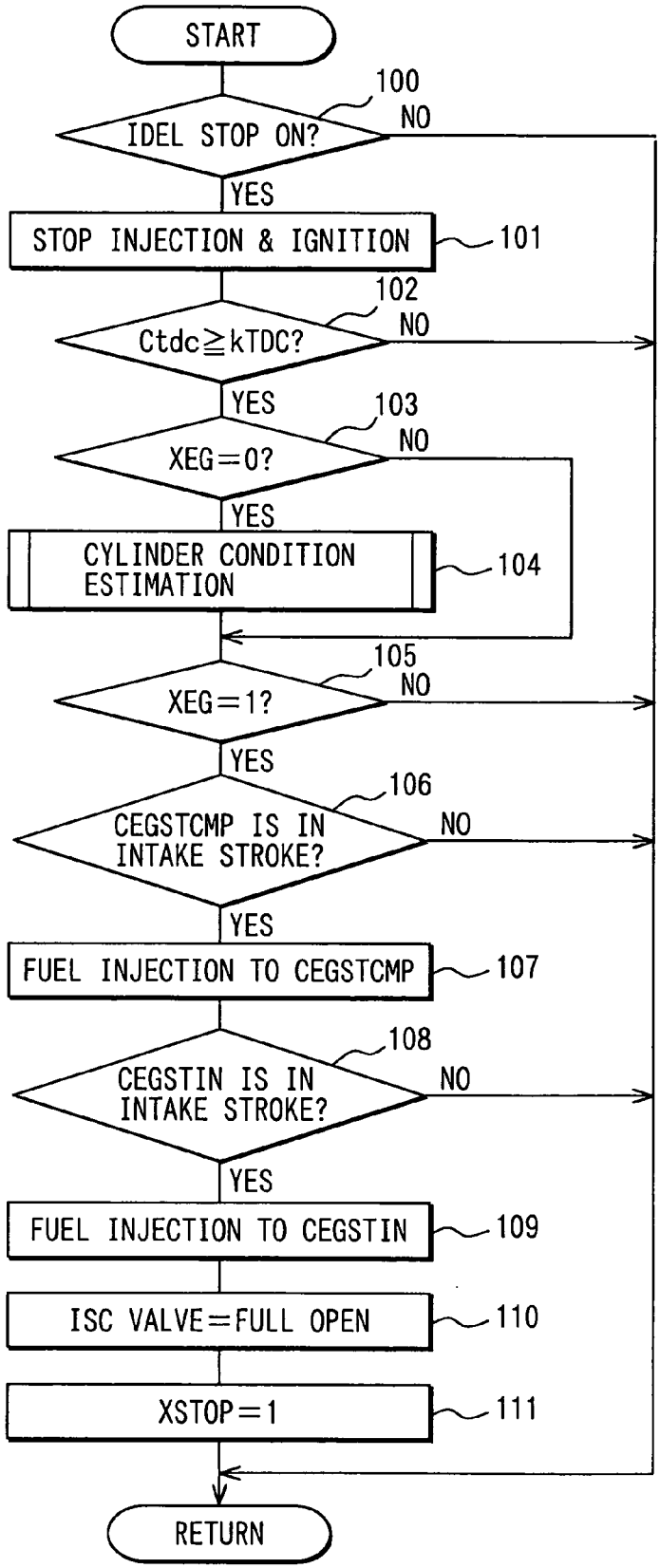
FIG. 7 is a flowchart showing an engine stop control routine.
Figure 8:
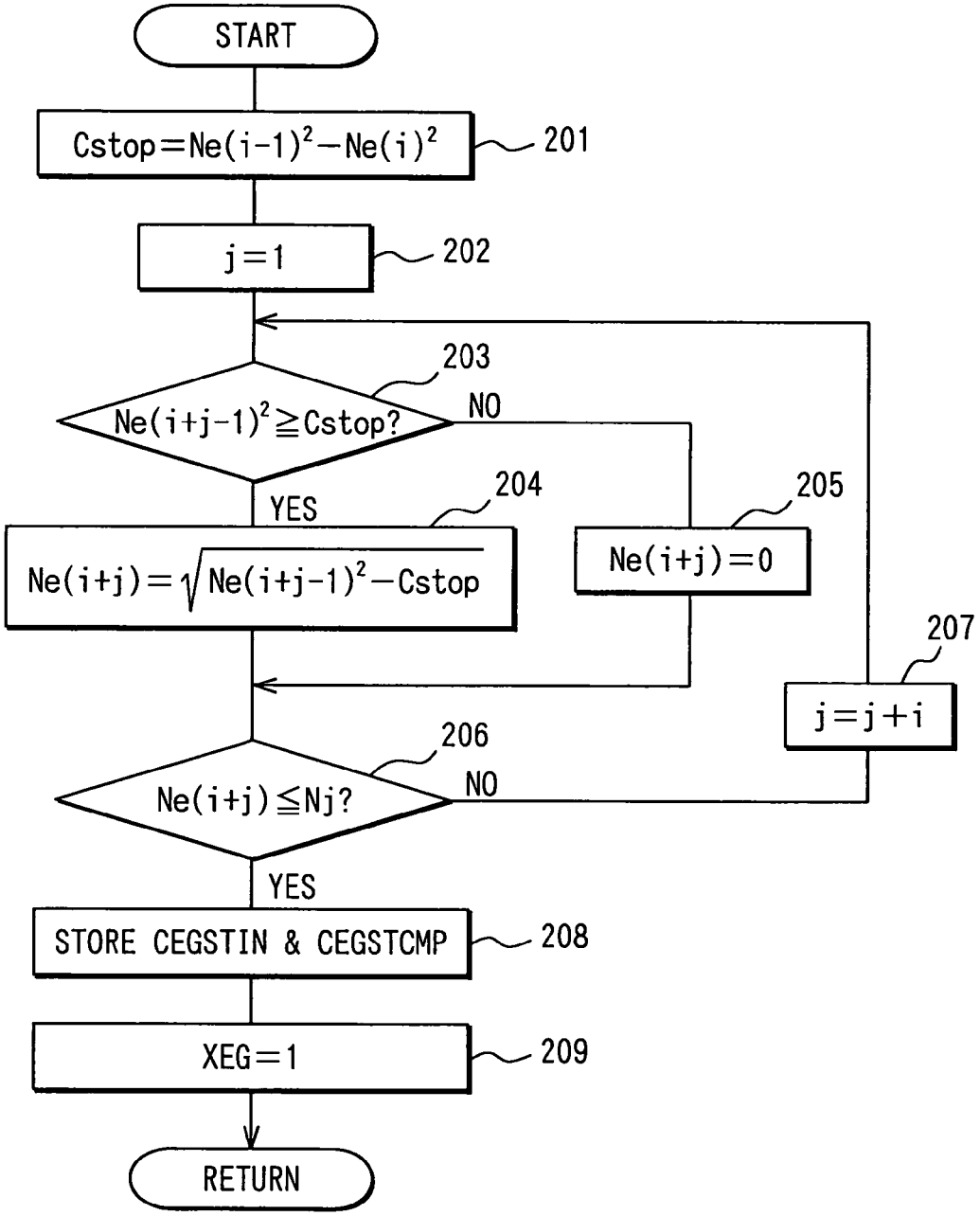
FIG. 8 is a flowchart showing a cylinder condition estimating routine.
Figure 9:
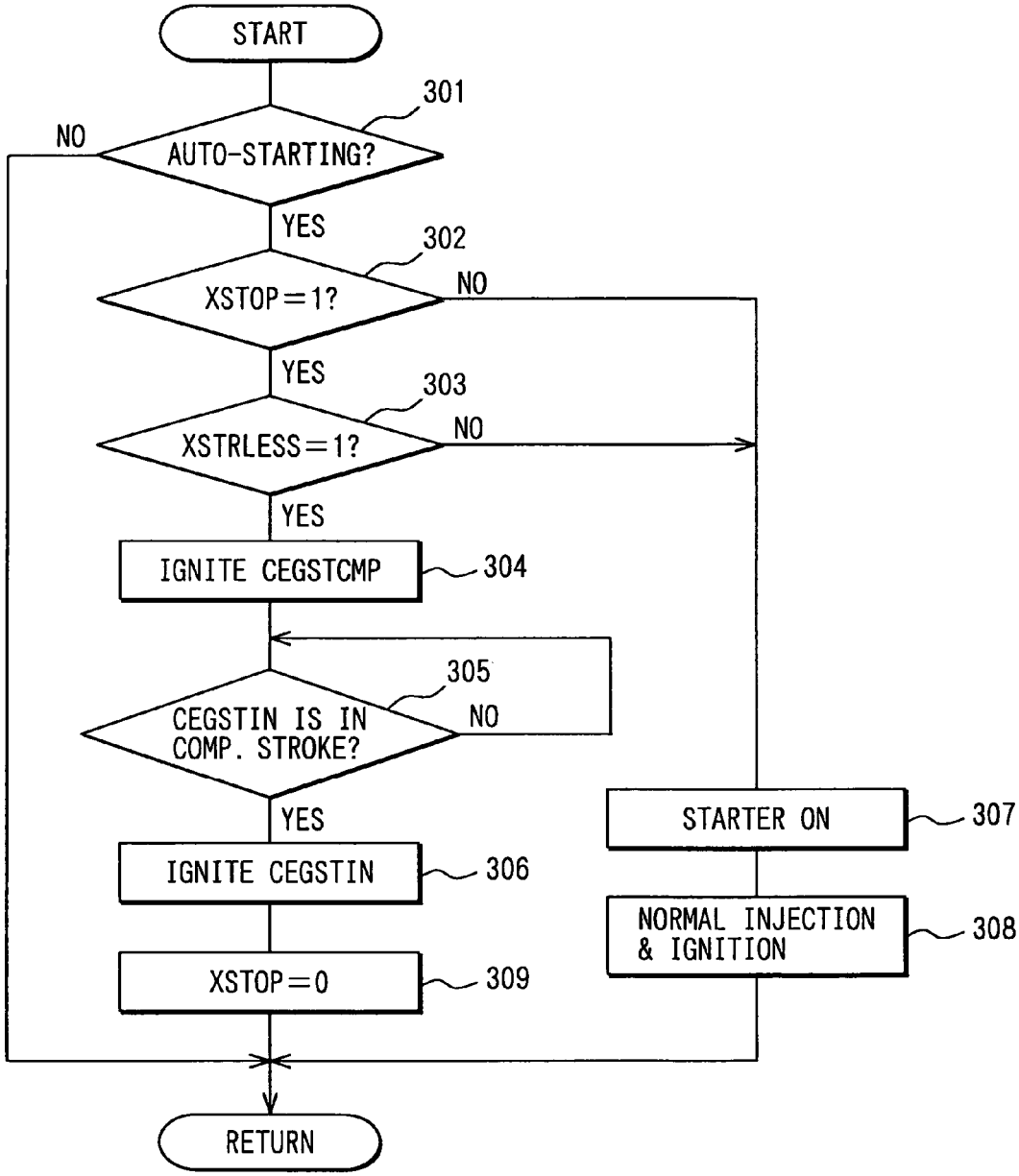
FIG. 9 is a flowchart showing a starter-motorless-start control routine.

The ECU 30 performs each routine shown in FIGS. 7 to 9, whereby crank angle determination, cylinder determination, calculation and storing of engine speed, calculation and storing of kinetic energy, calculation and storing of energy disturbing an engine operation, estimating calculation of future kinetic energy, estimating calculation of a future instantaneous engine speed, estimation of stop position of the engine (stroke of each cylinder with the engine stopped), and stop position control of the ISC valve 17 are conducted. The data of the engine stop position are stored in a backup RAM 32 (a nonvolatile memory) or a RAM, on which the starter-motorless-start is conducted.

Figure 2:
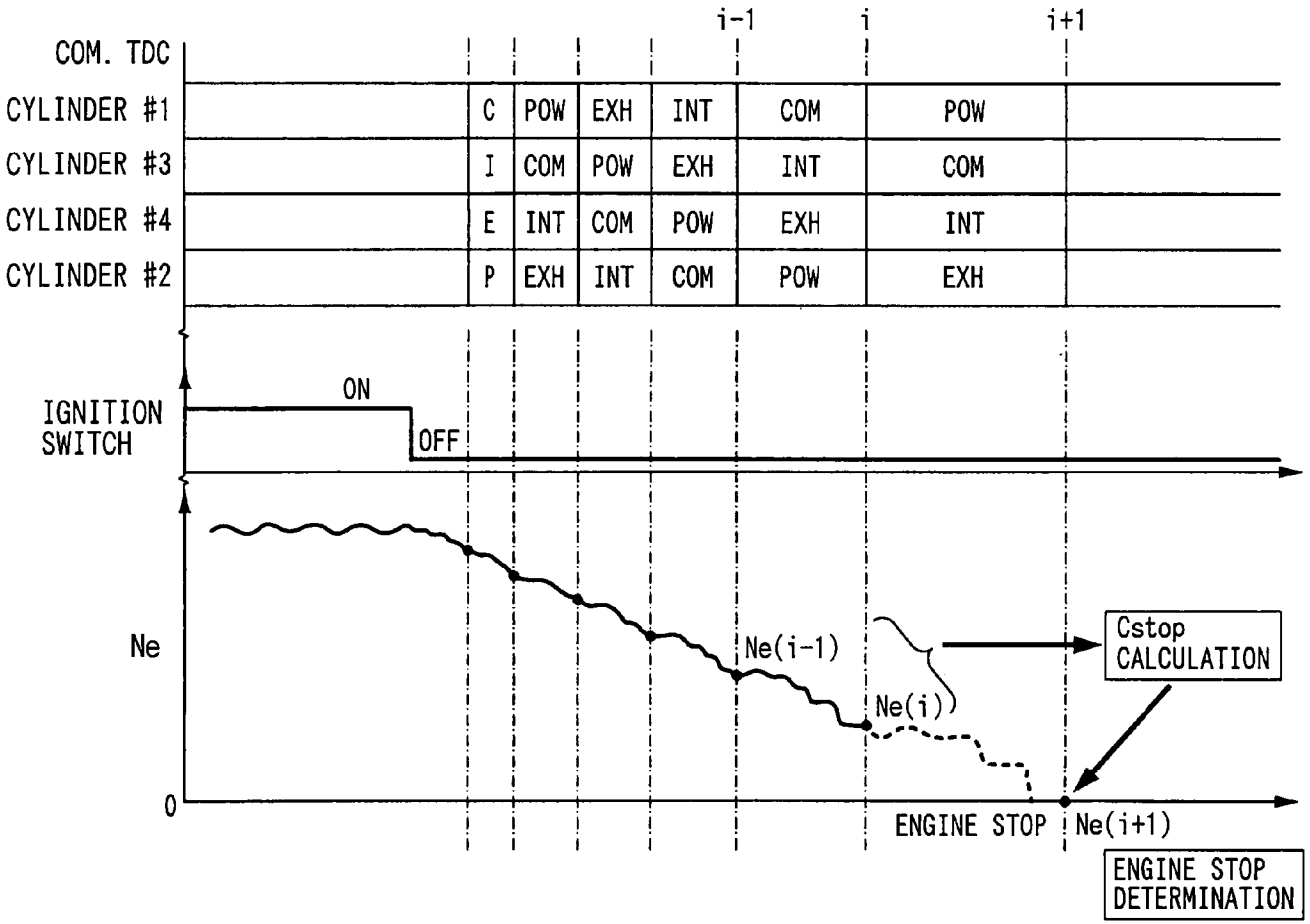
FIG. 2 is a time chart for explaining a method for estimating an engine stop position.

Referring to FIG. 2 which is a time chart showing a shut-down period of the engine, a method for estimating the engine stop position is described hereinafter. In this embodiment, an instantaneous engine speed Ne at each compression TDC is used as a parameter representing an operation of the engine. The ECU 30 calculates the instantaneous engine speed Ne by measuring a time period required for the crankshaft 24 to rotates 10° C.A based on intervals between crank signals.

An energy balance at the compression TDC, which is referred to as TDC (i) hereinafter, is considered. A pump-loss, friction loss at each portion, driving loss of each accessory are considered as energies which restricts a smooth operation of the engine. E (i−1) represents a kinetic energy at TDC (i−1). By the next TDC (i), the kinetic energy E (i−1) is decreased to E (i). The relation between E (i−1) and E (i) are expressed by following equation (1);

$$E(i)=E(i-1)-W \tag{1}$$

wherein, "W" represents a total of lost workloads from the time of TDC (i−1) to the time of TDC (i).

The kinetic energy E can be expressed by following equation (2);

$$E=J\times 2\pi^2\times Ne^2 \tag{2}$$

Wherein, "E" represents a kinetic energy of the engine, "J" represents a moment of inertia depending on each engine, and "Ne" represents the instantaneous engine speed.

The above equation (1) can be changed into a following equation (3) based on the equation (2). The equation (3) represents a variation of instantaneous engine speed.

$$Ne\,(i)^2 = Ne\,(i-1)^2 - \frac{W}{J\times 2\pi^2} \tag{3}$$

The second term of the above equation (3) is defined as a parameter Cstop representing an energy which restricts the smooth operation of the engine.

$$Cstop = \frac{W}{J\times 2\pi^2} \tag{4}$$

This parameter Cstop is calculated based on the following equation (5).

$$Cstop=Ne(i-1)^2-Ne(i)^2 \tag{5}$$

The parameter Cstop is defined based on the workloads W and the moment of inertia J as shown by the equation (4).

When the engine is running at a low speed, such as in the shut-down period, the pump loss, the friction loss, and driving loss of the accessory are substantially constant without respect to the engine speed Ne. Thus, the workload W is substantially constant at any intervals between adjacent TDCs. The moment of inertia J is an inherent value of the engine, so that the parameter Cstop is substantially constant during the shut-down period.

Based on an actually measured instantaneous engine speed Ne (i) and the parameter Cstop derived from the equation (5), the estimated value of instantaneous engine speed Ne (i+1) at TDC (i+1) can be calculated based on following equations (6a) or (6b).

$$Ne(i+1)=\pi\sqrt{Ne(i)^2-Cstop} \tag{6a}$$

in case of Ne $(i)^2 \leqq$ Cstop.

$$Ne(i+1)=0 \tag{6b}$$

in case of Ne $(i)^2$<Cstop

In case of Ne $(i)^2$<Cstop, the workloads W is larger than the present kinetic energy E (i) of the engine, so that it is defined that Ne (i+1)=0 to avoid imaginary number of Ne (i+1).

By comparing the estimated instantaneous engine speed Ne (i+1) with a predetermined stop determination value Nth, it can be determined whether the engine will stop and it can be estimated the stroke condition of each cylinder at the engine stop position. However, in this method, since it is determined whether the engine will stop based on the estimated instantaneous engine speed Ne (i+1), the engine stop position is estimated just before the engine stops.

In a cylinder condition estimating routine shown in FIG. 8, the process repeatedly conducted that the more future instantaneous engine speed is estimated based on the future instantaneous engine speed and the parameter Cstop. Thus, the engine stop position can be estimated even if it is just before the engine stops.

Figure 3:
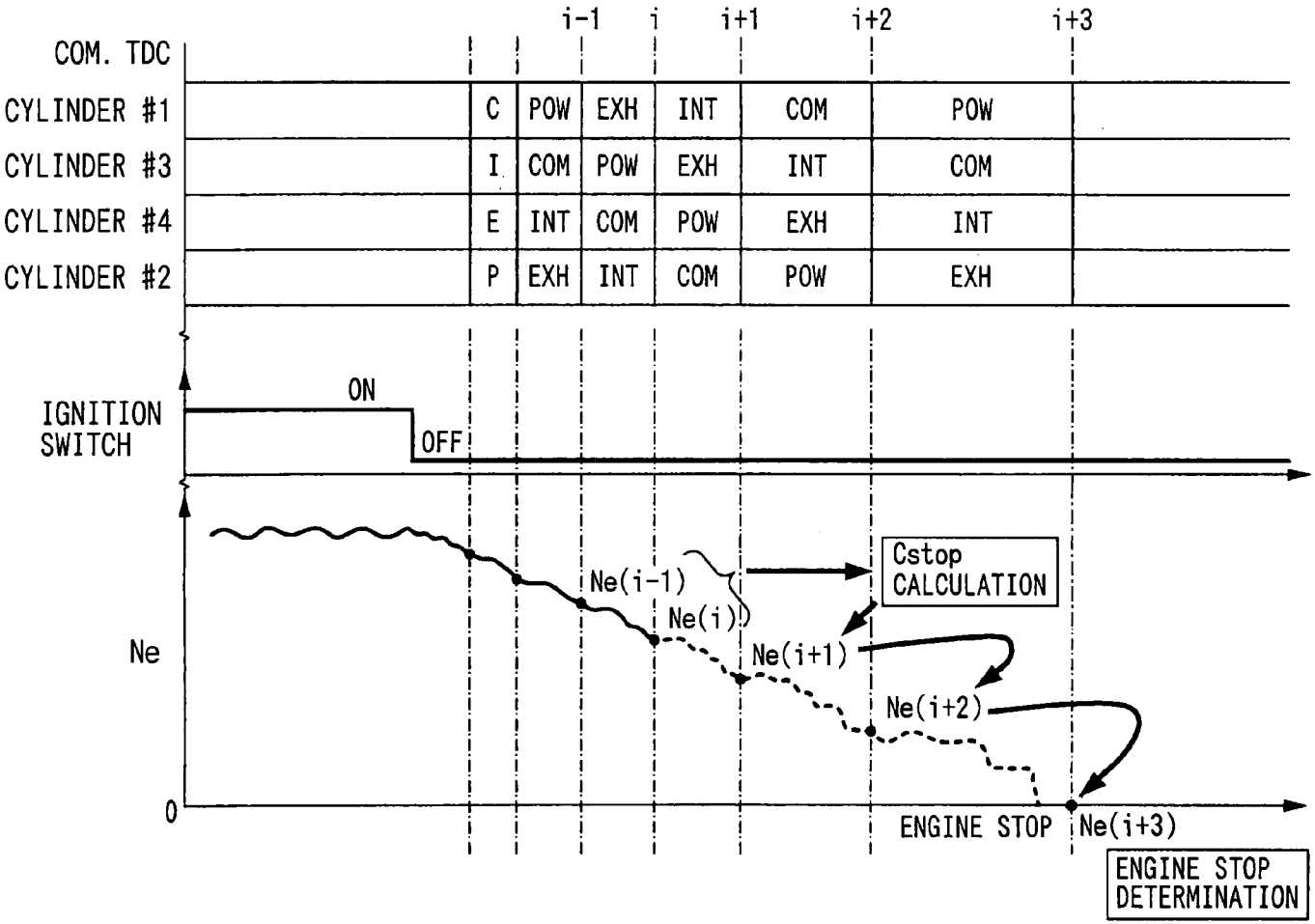
FIG. 3 is a time chart for explaining a method for estimating the engine stop position.
Figure 4:
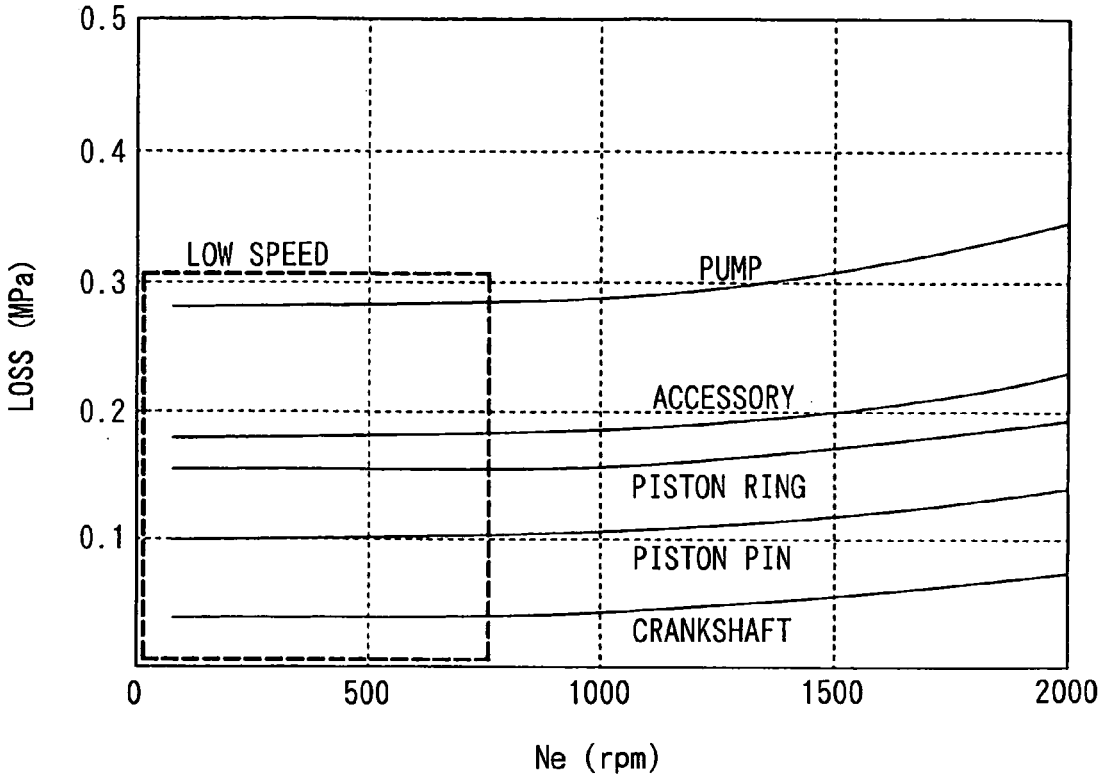
FIG. 4 is a graph showing a relation between an engine speed and a various kind of loss.

Referring to FIG. 3 which is a time chart, this engine stop position estimating method is described. At TDC (i) in the engine shut-down period, the parameter Cstop and an estimated value of the instantaneous engine speed Ne (i+1) are calculated.

As described above, the parameter Cstop is substantially constant in an engine shut-down period. An estimated value of the estimated instantaneous engine speed Ne (i+2) at TDC (i+2) is calculated based on the parameter Cstop and calculated instantaneous engine speed Ne (i+1) according to following equations (7a) and (7b).

$$Ne(i+2)=\pi\sqrt{Ne(i+1)^2-Cstop} \quad (7a)$$

in case of Ne $(i+1)^2 \geqq Cstop$.

$$Ne(i+2)=0 \quad (7b)$$

in case of Ne $(i+1)^2 < Cstop$

The process in which future instantaneous engine speed is calculated is repeatedly conducted until the estimated value of the instantaneous value becomes lower than the stop determination value, and then it is estimated that the engine will stop just before TDC at which the estimated value becomes lower than the stop determination value.

Figure 5:
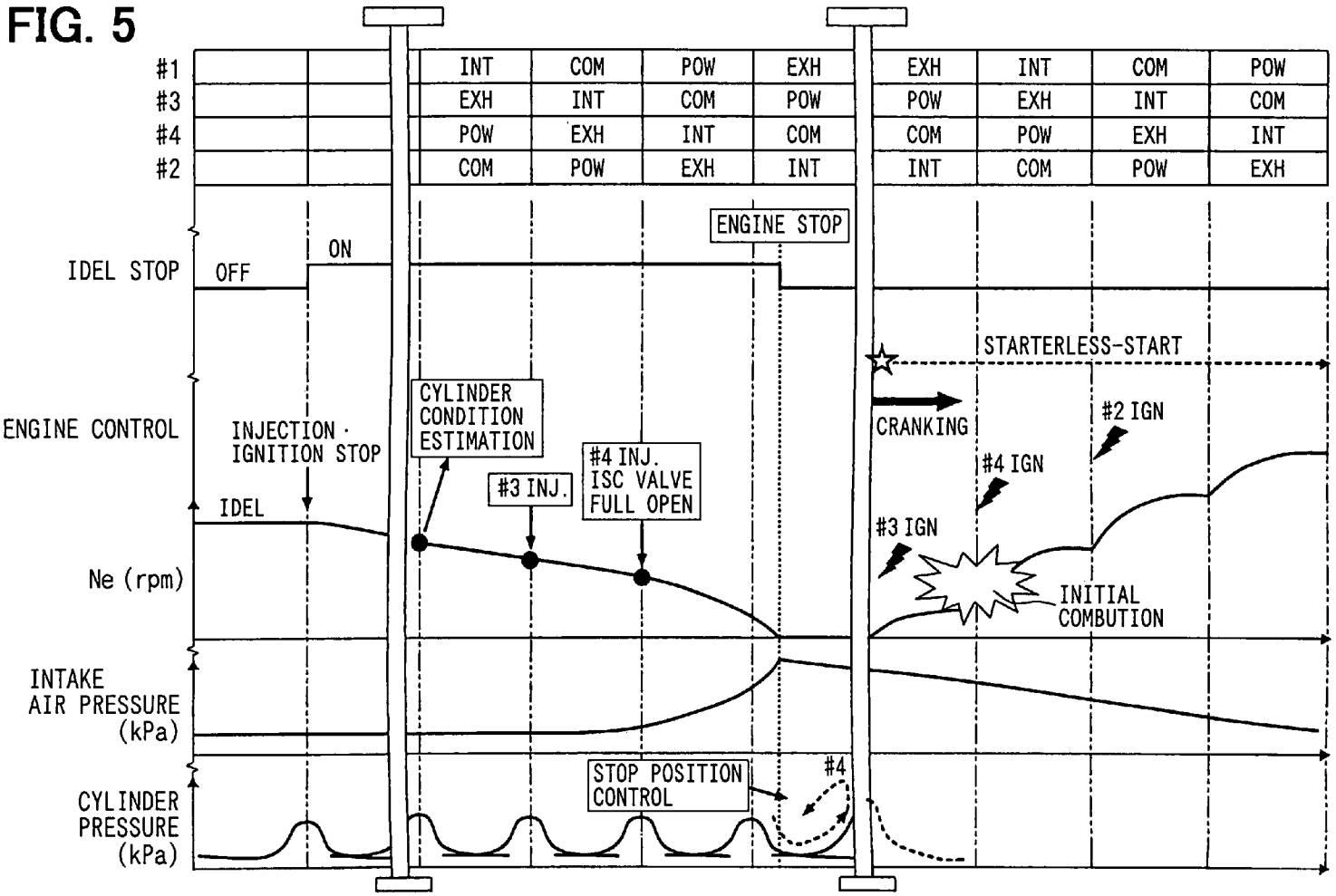
FIG. 5 is a time chart for explaining an engine stop position control and a starter-motorless-start control.

An outline of an engine stop control is described based on a time chart shown in FIG. 5.

When the idle stop signal is turned on during the idle to stop fuel injection and ignition, the engine continues to run for a while because of inertia energy. The engine speed is decreased due to each of the loss. During the engine shut-down period, the stroke condition of each cylinder is estimated. While the cylinder (#4 cylinder in FIG. 5) that is estimated to be stopped in the compression stroke is in the intake stroke just before the engine stops (preferably at a beginning of the intake stroke or vicinity thereof), the ICS valve 17 is fully opened to increase the intake air amount. Thus, the compression pressure in compression stroke cylinder is increased and the energy restricting the smooth rotation of the engine is increased to forcibly stop the engine.

During the engine shut-down period, after the stroke of each cylinder is estimated, with respect to the cylinder (#3 cylinder) that is estimated to be stopped in the power stroke and the cylinder (#4 cylinder) that is estimated to be stopped in the compression stroke, the fuel required for next starting is respectively injected in the intake stroke (preferably at the beginning of intake stroke or vicinity thereof). The ISC valve 17 is fully opened to increase the compression pressure in the compression stroke cylinder. Then, the engine is stopped in a condition in which the air-fuel mixture is hold in the compression stroke cylinder and the power stroke cylinder at engine stop timing.

Figure 6:
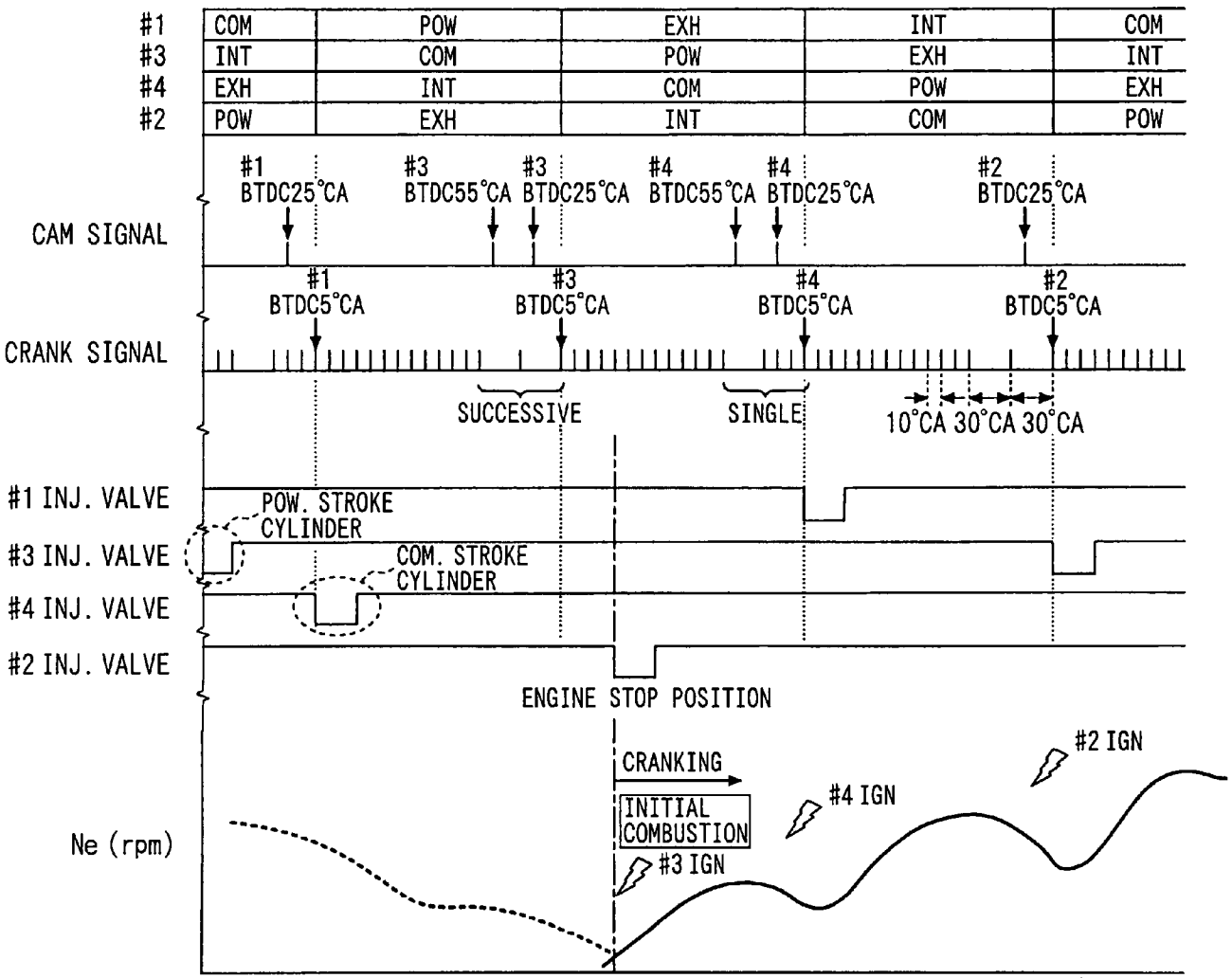
FIG. 6 is a time chart for explaining an engine stop position control and a starter-motorless-start control.

The starter-motorless-start control is described based on a time chart shown in FIG. 6. The ignition is conducted in the order of #1 cylinder, #3 cylinder, #4 cylinder, and #2 cylinder in this series. The cylinder determination and TDC determination are conducted based on the crank signal and cam signal. The compression stroke cylinder is #4 cylinder, and the power stroke cylinder is #3 cylinder in which air-fuel mixture is hold.

When the auto start condition such as an accelerator operation by the driver is established during idle stop, the starter-motorless-start control is started. The computer reads the information about the cylinder stroke stored in the backup RAM 32. The air-fuel mixture in the power stroke cylinder (#3 cylinder in FIG. 6) is ignited to start the cranking by the combustion energy thereof. After that, the cylinder determination is finished when BTDC 5° C.A (single lacked teeth) of the compression stroke cylinder (#4 cylinder) is detected. Then, the ignition is conducted in the compression stroke cylinder (#4 cylinder) at a predetermined ignition timing. Thereby, the consecutive combustion is occurred in the order of #3 cylinder and #4 cylinder to start the engine 11 without a starter (not shown).

When the ignition is conducted in the power stroke cylinder (#3 cylinder in FIG. 6) to start the cranking, the fuel is injected into the intake stroke cylinder (#2 cylinder). After the cylinder determination, the fuel is injected into each cylinder in synchronization with the intake stroke of each cylinder and the ignition is conducted in synchronization with the compression TDC of the compression stroke cylinder.

The above starter-motorless-start control is executed by ECU 30 according to the routine shown in FIGS. 7 to 9.

[Engine Stop Control Routine]

An engine stop control routine shown in FIG. 7 is executed every TDC. In step 100, the computer determines whether the idle stop signal is turned on. When it is No in step 100, the routine ends without executing further steps.

When it is Yes in step 100, the procedure proceeds to step 101 in which the fuel injection and ignition of the fuel is stopped to automatically stop the engine 11. In step 102, the computer determines whether a count number of a TDC counter Ctdc is equal to or greater than a predetermined number kTDC (for example, one ore two). The TDC counter Ctdc counts the number of TDC during engine shut-sown period. When the count number is less than kTDC, the routine ends without executing further steps. This process is conducted because the engine speed Ne is relatively high just after the fuel injection and ignition are stopped, so that the parameter Cstop is hardly calculated to accurately estimate the engine stop position.

When it is Yes in step 102, the procedure proceeds to step 103 in which a flag XEG is "0" that represents the cylinder condition has not been estimated yet. When it is determined Yes in step 103, the procedure proceeds to step 104 in which the cylinder condition (the power stroke cylinder CEGSTCMP and the compression stroke cylinder CEGSTIN) is estimated by executing a cylinder condition estimating routine shown in FIG. 8. When it is No in step 103, the procedure proceeds to step 105.

In step 105, the computer determines whether the flag XEG is "1". When it is No in step 105, the procedure ends to terminate the routine.

When it is Yes in step 105, the procedure proceeds to step 106 in which the present stroke of the power stroke cylinder CEGSTCMP is the intake stroke just before the engine stops. When it is No in step 106, the procedure ends. When it is Yes in step 106, the procedure proceeds to step 107 in which the fuel required to an initial combustion in the nest engine stating is injected into the power stroke cylinder CEGSTCMP while the cylinder is in the intake stroke just before the engine stops (preferably, at the beginning of the intake stroke or vicinity thereof.

In step 108, the computer determines whether the present stroke of the compression stroke cylinder CEGSTIN is the intake stroke just before the engine stops. When it is No in step 108, the procedure end without executing further processes. When it is Yes in step 109, the procedure proceeds to step 109 in which the fuel required to the initial combustion in the next engine starting is injected into the compression stroke cylinder CEGSTIN while the cylinder is in the intake stroke just before the engine stops (preferably, at the beginning of the intake stroke or vicinity thereof).

Then, the procedure proceeds to step 110 in which the ISC valve is fully opened to increase the amount of intake air, whereby the compression pressure in the compression stroke cylinder CEGSTIN is increased to forcibly stop the engine. In step 111, the flag XSTOP is turned to "1" that means the engine stop control has been finished.

The processes in steps 106 to 109 correspond to a fuel injection control means, and the process in step 110 corresponds to a stop position control means.

[Cylinder Condition Estimating Routine]

A cylinder condition estimating routine shown in FIG. 8 is a subroutine which is executed in step 104 in FIG. 7, and corresponds to a stroke estimating means. In step 201, the parameter Cstop is calculated based on the instantaneous engine speed Ne (i−1) at the previous TDC (i−1) and the instantaneous engine speed Ne (i) at the present TDC (i) according to the equation (5).

In step 202, a counter j is set to an initial value "1", which counts the number of estimation of the instantaneous engine speed. In steps 203 to 205, an instantaneous engine speed Ne (i+j) at a future TDC (i+j) after j-times strokes is calculated (initially, j=1). In step 203, the computer determines whether $Ne\ (i+j\ -1)^2 \geqq Cstop$. When it is Yes in step 203, the procedure proceeds to step 204 in which the instantaneous engine speed Ne (i+j) is calculated according to the equation (6). When it is No in step 203, the procedure proceeds to step 205 in which the instantaneous engine speed Ne (i+j) is set "0".

In step 206, the computer determines whether the engine will stop before the TDC (i+j) according to whether the instantaneous engine speed Ne (i+J) is equal to or lower than a predetermined stop determination number Nj. When it is No in step 206, the procedure proceeds to step 207 in which the counter j is incremented by "1" to return to step 203.

As described above, the calculation of the instantaneous engine speed is repeatedly conducted until the instantaneous engine speed Ne (i+j) drops below the stop determination number Nj in order to estimate the instantaneous engine speed Ne (i+j) in the time interval of TDC.

When it is Yes in step 206, the computer determines that the engine will stop just before the Ne (i+j) at the TDC (i+j), and then the procedure proceeds to step 208 in which the stroke conditions (the power stroke cylinder CEGSTCMP and the compression cylinder CEGSTIN) of each cylinder from the time at the TDC (i+j) to the time at the TDC (i+j−1) are stored in the backup RAM 32 or the RAM as the information about the engine stop position.

For example, when the computer determines the instantaneous engine speed Ne (i+3) at the TDC (i+3), which comes after three strokes, drops below the stop determination number Nj, it is determined that the engine will stop between the TDC (i+2) and the TDC (i+3) to store the stroke conditions (the power stroke cylinder CEGSTCMP and the compression cylinder CEGSTIN) from the time at the TDC (i+2) to the time at the TDC (i+3). Then, the procedure proceeds to step 209 in which the flag XEG is turned to "1" to end the routine.

[Starter-Motorless-Start Control Routine]

A starter-motorless-start control routine shown in FIG. 9 is executed at every predetermined time (for example, every 8 ms) and functions as a starter-motorless-start control means. In step 301, the computer determines whether the auto-start condition is established. The auto-start condition is established when the driver steps an acceleration pedal to start the vehicle.

When it is No in step 301, the procedure ends without executing further steps. When it is Yes in step 301, the procedure proceeds to step 302 in which the computer determines whether the flag XSTOP is turned to "1". When it is No in step 302, the computer determines that the engine stop control is normally finished so that the starterless-control cannot be conducted. The procedure proceeds to step 307 in which a starter is turned on to crank the engine. In step 308, the normal fuel injection and the ignition control are executed to start the engine 11.

When it is Yes in step 302, the computer determines that the preparation for the starterless-control is finished. That is, the air-fuel mixture is hold in the power stroke cylinder and the compression stroke cylinder, and the engine stop position is stored. The procedure proceeds to step 303 in which the computer determines whether a starter-motorless-start condition is established based on whether a starter-motorless-start determination flag XSTRLESS.="1". The starter-motorless-start condition is follows:

(1) The engine stop position is a position which is suitable for the starter-motorless-start. That is, the engine stop position is within a crank angle in which the cranking energy by the combustion pressure is kept enough.
(2) The engine stop time is within a predetermined period.
(3) The coolant temperature is not higher than a predetermined value.
(4) The intake air temperature is not higher than a predetermined value.

Even in the power stroke, when the stop position of the cylinder is close to the Bottom Top Center (BDC), the exhaust valve is immediately opened to release the combustion pressure, so that a minimum torque to start the engine is not obtained enough, which may cause a failure of the starter-motorless-start. Besides, since the pressure of the air-fuel mixture holed in the power stroke cylinder and the compression stroke cylinder is higher than the atmospheric pressure, the air-fuel mixture gradually leaks through a clearance at the intake and exhaust valve and a clearance between the piston and the cylinder according as the engine stop period is prolonged. Thus, when the engine stop period is prolonged, the air-fuel mixture in the power stroke cylinder and the compression stroke cylinder decrease to cause an incomplete combustion and a misfire in the starter-motorless-start. Furthermore, when an engine temperature (the coolant temperature) and the intake air temperature are relatively low, a combustion of the air-fuel mixture is deteriorated to cause the incomplete combustion and the misfire.

If at least one of the starter-motorless-start conditions is not satisfied, the starter-motorless-start is not conducted. When it is No in step 303, the procedure proceeds to step 307 in which the starter is turned on to crank the engine. In step 308, the normal fuel injection and the ignition control are executed to start the engine 11.

When it is Yes in step 303, the procedure proceeds to step 304 in which the power stroke cylinder CEGSTCMP is identified based on the engine stop information stored in the backup RAM or the RAM in order to ignite the power stroke cylinder CEGSTCMP and start the cranking of the engine by the combustion energy.

The, the procedure proceeds to step 305 in which it is determined whether the compression stroke cylinder CEGSTIN reaches the compression TDC. When the compression stroke cylinder CEGSTIN reaches the compression TDC, the procedure proceeds to step 306 in which the air-fuel mixture in the compression stroke cylinder CEGSTIN i ignited. Then, the procedure proceeds to step 309 in which the flag XSTOP is reset to end the routine.

According to the structure of the above embodiment, the starter-motorless-start in the intake port injection engine can be realized without increasing a production cost, and a noise due to the starter can be reduced. Furthermore, it is unnecessary to keep the engine stop position constant, so that the engine inertially running can be stopped smoothly by the kinetic energy loss which restricts the rotation of the engine.

The present invention can be applied to the engine when the driver operates an ignition key to start or stop the engine.

According to the embodiment, the compression pressure in the compression stroke cylinder is increased to stop the engine, so that the engine stop position can be controlled to a suitable position for starter-motorless-start. By utilizing the ISC valve 7 equipped with engine, the engine stop position is controlled so that any additional equipment is unnecessary.

The intake air amount to the compression stroke cylinder can be increased by using an electrically driven throttle valve or a variable valve mechanism instead of the ISC valve 17.

The present invention can be modified to a structure which has no engine stop position control. In this case, only when the engine stop position is estimated to be in a predetermined crank angle range in which the starter-motorless-start can be conducted, the fuel is injected into the power stroke cylinder and the compression stroke cylinder.

In the above embodiment, the engine 11 has four intake air ports. The engine 11 can have less than or more than four intake air ports.

What is claimed is:

1. An engine controller controlling start and stop of an engine that has an intake port to which a fuel is injected, the engine controller comprising:

a stroke estimating means for estimating, during a shut-down period of the engine, a stroke of each cylinder when the engine is stopped, the stroke estimating means storing an estimated result;

a fuel injection control means for injecting a fuel, which is required to start the engine in a next starting time, into the cylinder which is estimated to be stopped in a power stroke or in a compression stroke based on the estimated result; and a starter-motorless-start control means for igniting and combusting an air-fuel mixture in the cylinder that is estimated to be stopped in the power stroke so as to begin a cranking by a combusting energy of the air-fuel mixture, the starter-motorless-start control means igniting, at a next ignition timing, an air-fuel mixture in the cylinder that is estimated to be stopped in compression stroke in order to start the engine without an aid of a starter.

2. The engine controller according to claim 1, wherein the stroke estimating means calculates a first parameter representing a movement of the engine and a second parameter representing an energy restricting the movement of the engine, estimates a third parameter representing a future movement of the engine based on the first and the second parameters, and estimates strokes of each cylinder when the engine is stopped based on the third parameter.

3. The engine controller according to claim 2, wherein the stroke estimating means estimates a future instantaneous engine speed as the third parameter, and estimates that the engine will stop in a cylinder condition at a time when the future instantaneous engine speed drops below a predetermined speed.

4. The engine controller according to claim 1, further comprising:

a stop position control means for stopping the engine by means of increasing an intake air amount in a compression stroke cylinder, which is estimated to be stopped in the compression stroke, during an intake stroke period just before the engine is stopped, in order to increase a compression pressure in the compression stroke cylinder.

5. The engine controller according to claim 1, further comprising:

an auto stop means for stopping the engine by terminating a fuel injection and a spark ignition when a predetermined auto stop condition is established with the engine at idle, wherein the stroke estimating means performs a stroke estimation of each cylinder, and the fuel injection control means performs a fuel injection control, during a shut-down period of the engine based on an operation of he auto stop means, and the starter-motorless-start control means ignites an air-fuel mixture in the cylinder which is estimated to be stopped in the power stroke to start a cranking by a combustion pressure thereof based on the stored estimated result when a predetermined auto start condition is established, and ignites an air-fuel mixture in the cylinder which is estimate to be stopped in the compression stroke to start the engine without an aid of a starter.

6. The engine controller according to claim 1, wherein the starter-motorless-start control means determines whether a starter-motorless-starting, which represents a starting of the engine without the aid of the starter, can be conducted based on an engine stop position, an engine stop period and an engine temperature, and when the starter-motorless-start control means determines that the starter-motorless-start cannot be conducted, a cranking of the engine is performed by the starter.

* * * * *